US005474216A

United States Patent [19]

Harrod et al.

[11] Patent Number: 5,474,216

[45] Date of Patent: Dec. 12, 1995

[54] METHOD AND APPARATUS FOR CONCURRENTLY PRESSING THE FRONT AND BACK OF A SHIRT AND FINISHING THE SLEEVES THROUGH THE USE OF A SINGLE SOURCE OF AIR PRESSURE

[76] Inventors: Michael K. Harrod, 1533 High Crest Cir., Valrico, Fla. 33594; Charles E. Devrick, 11629 Country Run Rd., Tampa, Fla. 33624

[21] Appl. No.: 228,413

[22] Filed: Apr. 15, 1994

[51] Int. Cl.[6] ..... D06C 15/00; A41H 5/00

[52] U.S. Cl. ..... 223/57; 223/70; 223/68

[58] Field of Search ..... 223/57, 70, 71, 223/68, 69, 52; 38/10, 14, 6

[56] References Cited

U.S. PATENT DOCUMENTS

| | | | |
|---|---|---|---|
| 2,834,523 | 5/1958 | Maxwell et al. | 223/57 |
| 2,875,929 | 3/1959 | Langen et al. | 223/57 |
| 3,173,820 | 3/1965 | Adlee | 223/57 |
| 3,384,347 | 5/1968 | Lornitzo | 223/57 |
| 3,463,367 | 8/1969 | Campbell et al. | 223/57 |
| 3,471,067 | 10/1969 | Stewart | 223/57 |
| 3,568,900 | 3/1971 | Palis | 223/70 |
| 3,654,714 | 4/1972 | North | 38/16 |
| 3,679,106 | 7/1972 | North et al. | 223/73 |
| 3,715,064 | 2/1973 | North et al. | 223/57 |
| 4,634,030 | 1/1987 | Uchikoshi | 223/57 |
| 4,843,745 | 7/1989 | Oberley | 38/34 |
| 5,012,962 | 5/1991 | Oberley, et al. | 223/57 |
| 5,065,535 | 11/1991 | Gill et al. | 38/22 |

OTHER PUBLICATIONS

Sankosha Brochure "Shirt—Master CN-560-One Touch Fully Automatic Shirt Finisher".
Sankosha Manual "Sun—Master CN-561-Single-Buck Shirt Press".
Ajax Brochure "Single—Buck Cabinet-Bosom Body & Yoke Vacuum Press CBBY-V".
Ajax Manual "Product Code 770 Only".
Colmac Brochure "A New Standard in Shirt Pressing".
Colmac Manual
Weston "Shirtmaster Double Buck Model V. 1582 Instruction Booklet".
Forenta "Professional Laundry Finishing Equipment" Brochure.
Spencer "Swiftpress" Brochure.
Neil and Spencor "Airlay" Manual.

*Primary Examiner*—C. D. Crowder
*Assistant Examiner*—Bibhu Mohanty
*Attorney, Agent, or Firm*—Dominik & Stein

[57] ABSTRACT

Method and apparatus for finishing a shirt comprising a buck with a first drive means to move the buck between a loading and a finishing zone; a pair of chests positioned adjacent to the buck at the finishing zone with a second drive means to move the chests between inoperative and operative positions; a pair of clips to receive an area of a shirt on the buck to be pressed at the region between the cuff and sleeve and to form an obstruction for the flow of heated air and steam therethrough during a finishing operation; steam lines for coupling a source of steam to the interior of the chests; air lines for coupling a source of negative air pressure to the buck for drawing a vacuum through the buck when the buck is in the loading zone for holding a shirt against the buck and to provide a positive air pressure to the interior of the buck to force the sleeves outwardly to effect their finishing; and a single blower to generate a positive air pressure and a negative air pressure coupled to the buck with associated control mechanism to apply positive air pressure to the buck when in the finishing zone and negative air pressure to the buck when in the loading zone.

4 Claims, 13 Drawing Sheets

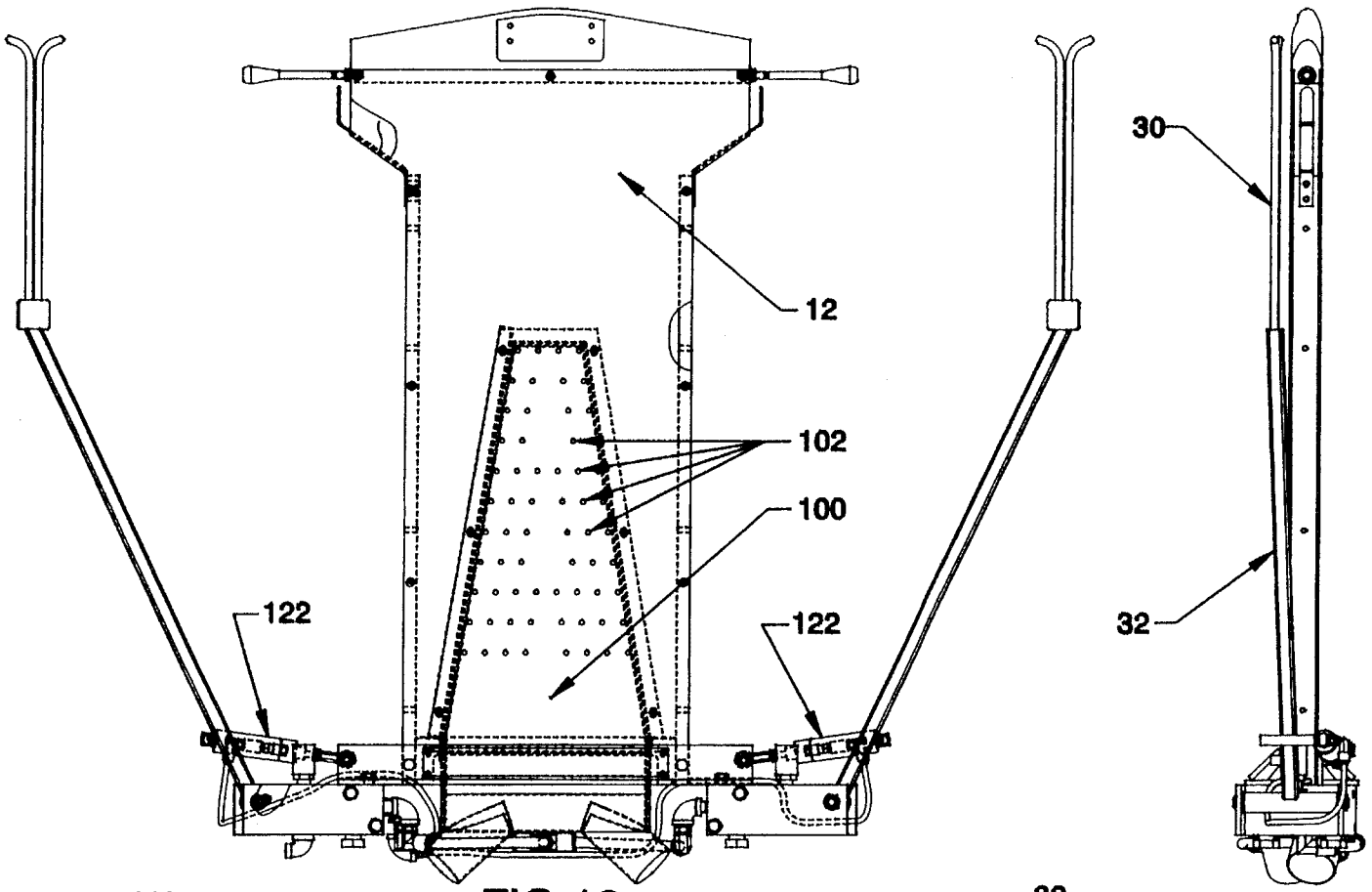
FIG 13
FIG 15
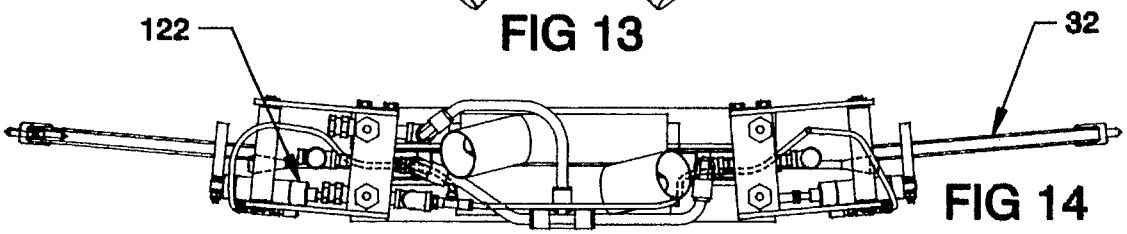
FIG 14

METHOD AND APPARATUS FOR CONCURRENTLY PRESSING THE FRONT AND BACK OF A SHIRT AND FINISHING THE SLEEVES THROUGH THE USE OF A SINGLE SOURCE OF AIR PRESSURE

BACKGROUND OF THE INVENTION

1. Field of the Invention

This invention relates to method and apparatus for concurrently pressing the front and back of a shirt and finishing the sleeves through the use of a single source of air pressure and, more particularly, to diverting a flow of air of a positive pressure for finishing the sleeves and of a negative pressure for holding the shirt on a buck through the use of a single blower and operatively associated valves.

2. Description of the Background Art

Presently, in the field of finishing shirts, three separate machines are normally utilized. The first machine is for pressing the collars and cuffs. The second machine is for finishing the sleeves. The third machine is for pressing the body of the shirt. A continuing effort is being made to increase the efficiency of the shirt finishing process by minimizing the number of machines necessary for the finishing and by simplifying the machines. By way of example, consider U.S. Pat. No. 3,654,714 to North directed to a steam-air garment press; U.S. Pat. No. 3,679,106 to Beckett directed to a control system for garment finishing apparatus; U.S. Pat. No. 3,715,064 to Eubank directed to a garment finishing apparatus; U.S. Pat. No. 4,634,030 to Uchikoshi directed toward a laundry presser for simultaneously pressing multiple clothing sections; U.S. Pat. No. 4,843,745 to Oberlye directed toward a press and method of making same; U.S. Pat. No. 5,012,962 to Downie directed toward an indexing mechanism for a mannequin carriage having a slidable, pivotable support and index bar moveable by a fluid cylinder for movement between a dressing position and a garment press; and lastly, U.S. Pat. No. 5,065,535 to Gill directed toward an indexing system for rotary garment press.

Nothing in the prior art provides the benefits attendant with the present invention.

Therefore, it is an object of the present invention to provide an improvement which overcomes the inadequacies of the prior art devices and which is a significant contribution to the advancement of the art.

Another object of the present invention is to press the front and back of a shirt while concurrently finishing its sleeves.

A further object of the present invention is to use a single source of air pressure for holding a shirt on a buck and for finishing the sleeves.

A further object of the present invention is to use valves to divert a constant flow of air between a positive source of pressure to a negative source of pressure.

It is a further object of the present invention to increase the efficiency, simplicity and safety of shirt finishing machines while reducing the cost through reduced equipment.

Lastly, it is an object of the present invention to provide a new and improved method and apparatus for finishing a shirt comprising a buck with a first drive means to move the buck between a loading and a finishing zone; a pair of chests positioned adjacent to the buck at the finishing zone with a second drive means to move the chests between inoperative and operative positions; a pair of clips to receive an area of a shirt on the buck to be pressed at the region between the cuff and sleeve and to form an obstruction for the flow of heated air and steam therethrough during a finishing operation; steam lines for coupling a source of steam to the interior of the chests; air lines for coupling a source of negative air pressure to the buck for drawing a vacuum through the buck when the buck is in the loading zone for holding a shirt against the buck and to provide a positive air pressure to the interior of the buck to force the sleeves outwardly to effect their finishing; and a single blower to generate a positive air pressure and a negative air pressure coupled to the buck with associated control mechanism to apply positive air pressure to the buck when in the finishing zone and negative air pressure to the buck when in the loading zone.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a method and apparatus for concurrently pressing the front and back of a shirt and finishing the sleeves through the use of a single source of air pressure comprising a buck in the general form of a wearer having a front and a back and opposite lateral sides therebetween and adapted to hold at least the front and back of the shirt in an orientation for being pressed; first drive means to move the buck between a loading zone and a finishing zone; a pair of chests positioned adjacent to the buck at the finishing zone, the chests being movable between an inoperative position remote from the buck and an operative position proximate to each other and the buck and in pressing contact with a shirt on the buck; second drive means to move the chests between the inoperative and operative positions; a pair of clips, the clips including elongated generally vertical arms positioned on the opposite lateral sides of the buck and movable therewith between the loading and finishing zones, the lower ends of the arms being supported for independent rotation toward the lateral sides of the buck and away therefrom, the clips being formed with resiliently urged fingers at their upper ends and adapted to receive an area of a shirt on the buck to be finished at the region between the cuff and sleeve to form an obstruction for the flow of heated air and steam therethrough during a finishing operation; third drive means to retain the clips toward each other and the opposite lateral sides of the buck when the buck is in the loading zone and to retain the clips away from each other and the buck when the buck is in the finishing zone; steam lines for coupling (1) a reservoir of steam with the steam nozzle for live steam to be utilized during the finishing operation, (2) a heat exchanger over which air moving to the buck will pass and (3) in closed loops to the chests; air lines for coupling a source of negative air pressure and the buck to draw a vacuum through the buck when the buck is in the loading zone for holding a shirt against the buck and to provide a positive air pressure to the interior of the buck when the buck is in the finishing zone to force the sleeves outwardly to effect their finishing; and a single blower coupled to a positive pressure chimney and a negative pressure chimney and to the buck with associated control mechanisms to alternately apply positive air pressure to the buck when in the finishing zone and negative air pressure when the buck is in the loading zone.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 13 is front elevational view similar to FIG. 12 but with various external parts removed to shown certain internal constructions thereof.

FIG. 14 is a bottom plan view of the apparatus illustrated in FIG. 13.

FIG. 15 is a side elevational view of the apparatus shown in FIG. 13.

Similar reference characters refer to similar parts throughout the several views of the drawings.

DETAILED DESCRIPTION OF THE PREFERRED EMBODIMENT

Figure 1:
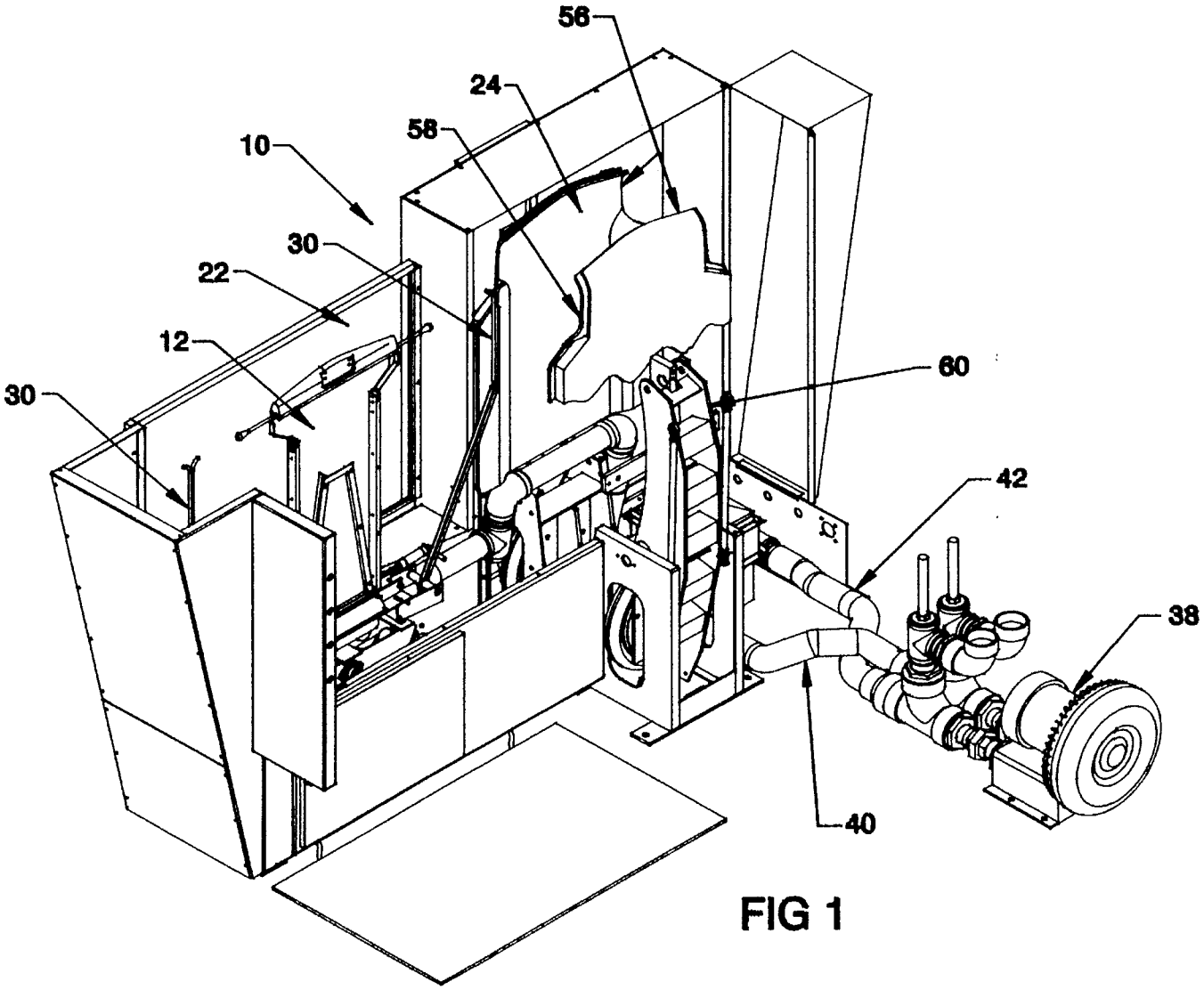
FIG. 1 is a perspective view of the preferred embodiment of the new and improved apparatus for concurrently pressing the front and back of a shirt while finishing the sleeves through the use of a single source of air pressure constructed in accordance with the principles of the present invention.
Figure 2:
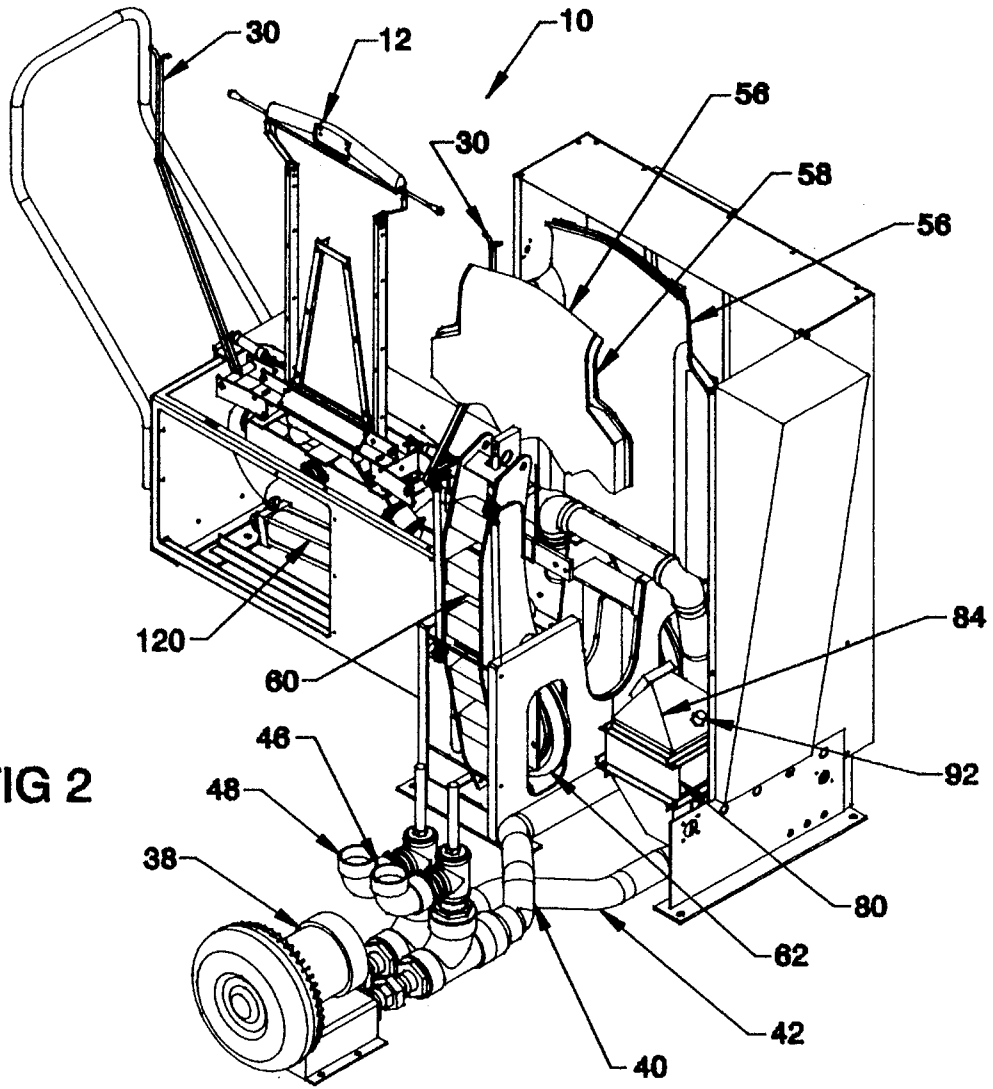
FIG. 2 is a perspective view of the apparatus shown in FIG. 1 but seen from an opposite side thereof and with various parts removed to show certain internal constructions thereof.

FIGS. 1 and 2 are perspective illustrations to provide an overview of the entire apparatus 10. The apparatus 10 has as its main component a buck 12. The buck 12 is in the general form of a wearer of a shirt. The buck has a contoured front 14 and a contoured back 14 and opposite lateral sides 16 therebetween. The buck is adapted to hold at least the front and back of the shirt to be finished in an orientation for being pressed.

Figure 5:
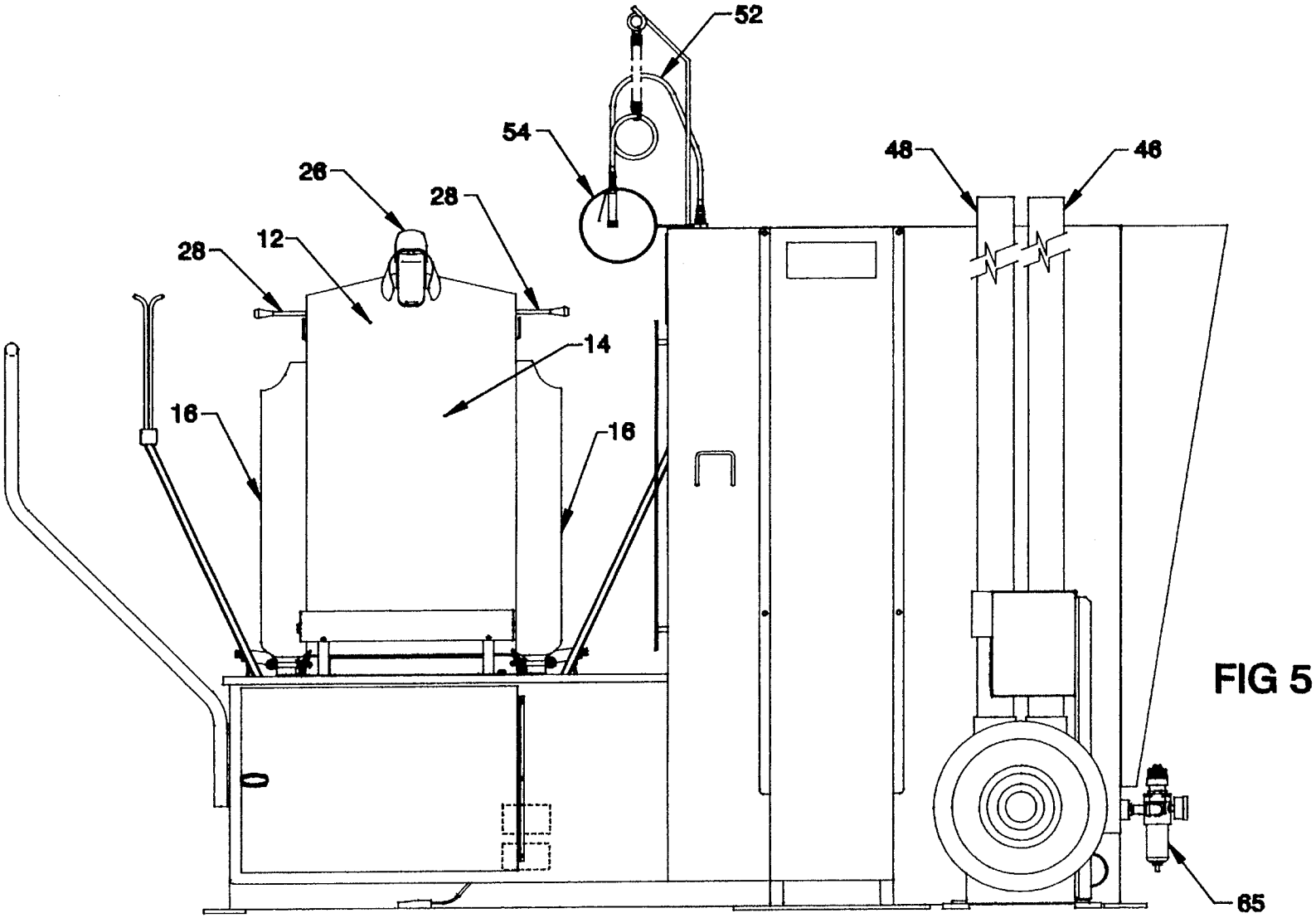
FIG. 5 is a front elevational view of the apparatus illustrated in the perspective showing of FIGS. 1 and 2.
Figure 6:
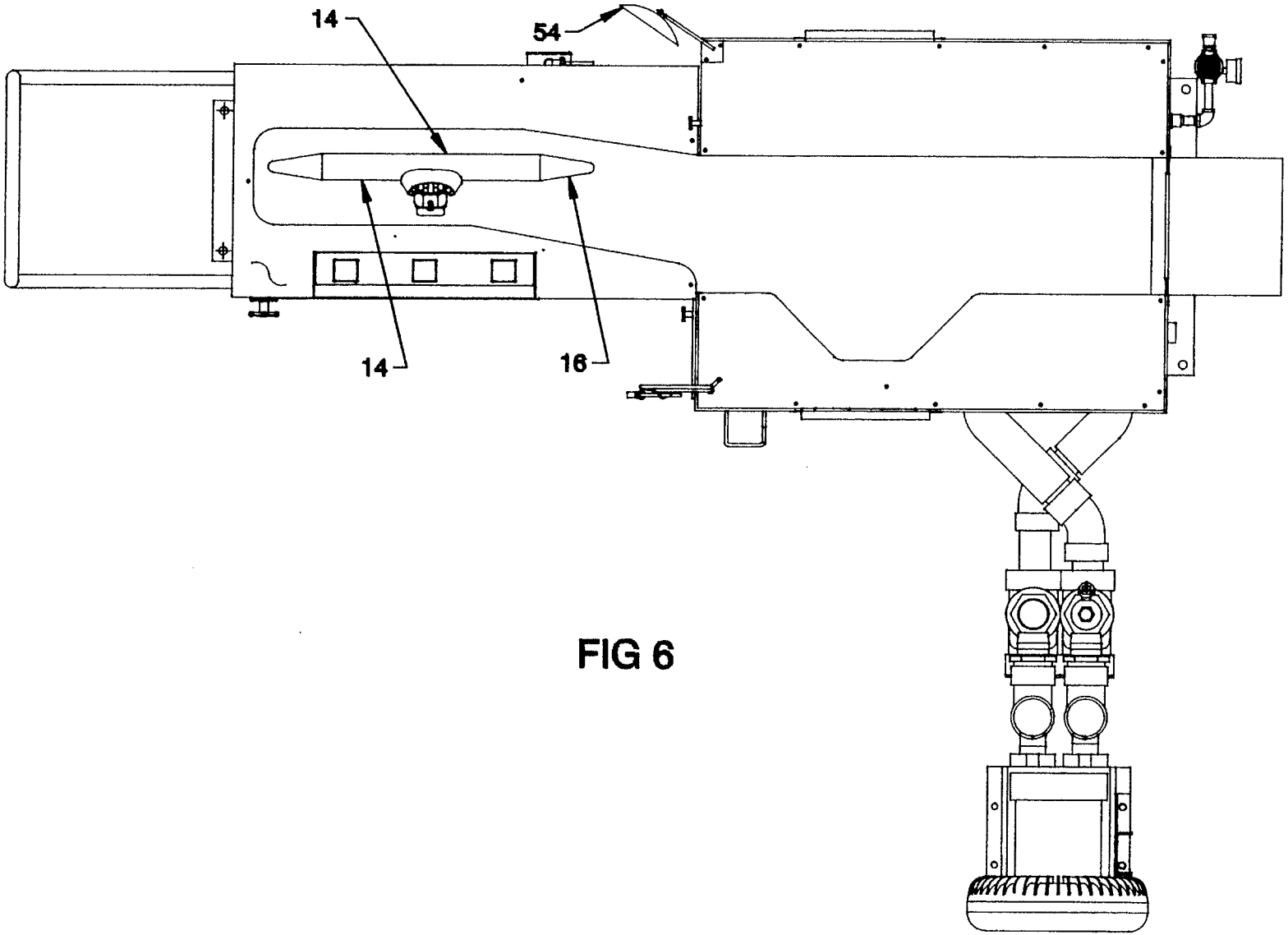
FIG. 6 is a top plan view of the apparatus illustrated in FIG. 5.
Figure 7:
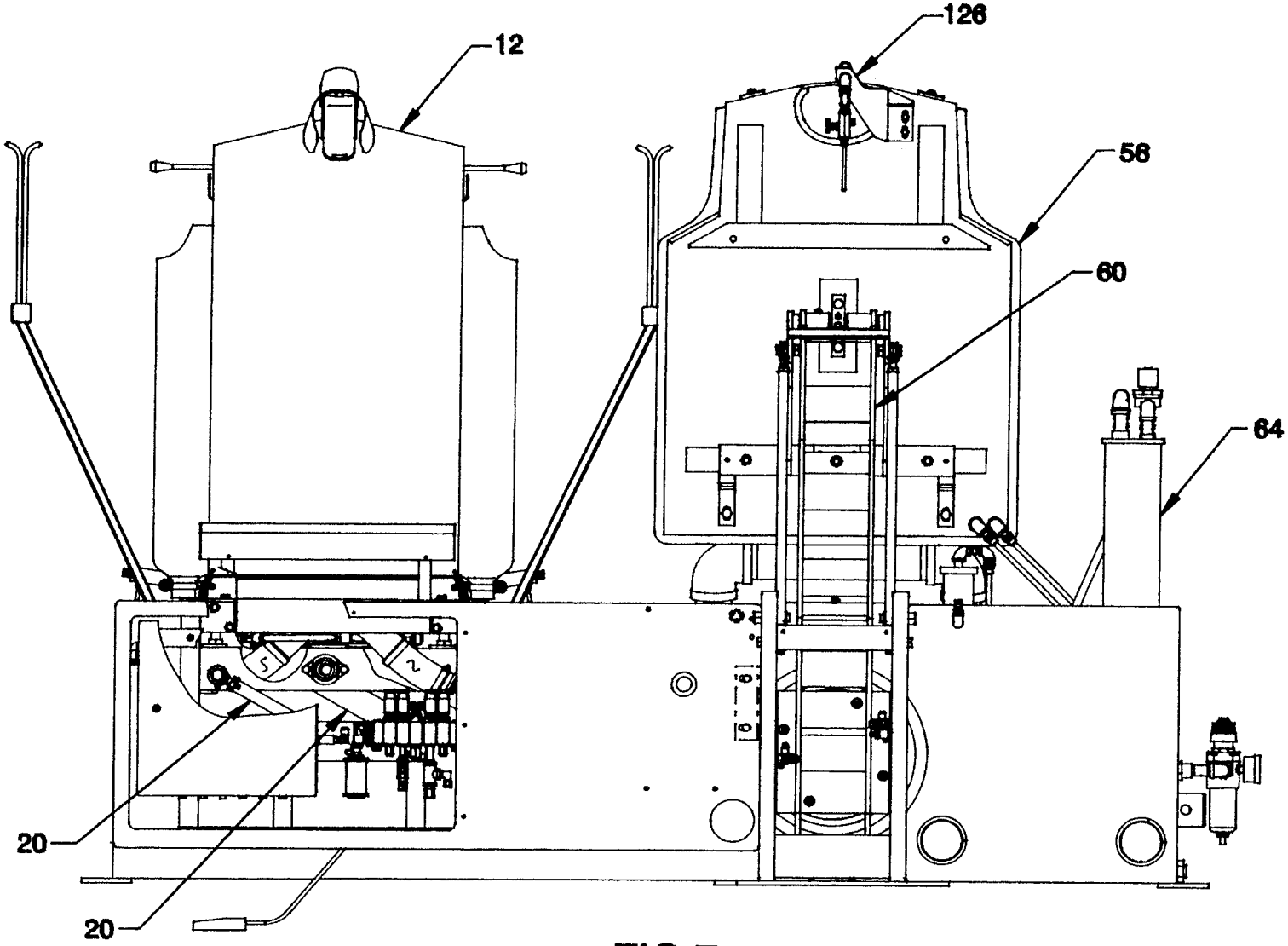
FIG. 7 is a front elevational view similar to FIG. 5 but with many of the covers removed.
Figure 8:
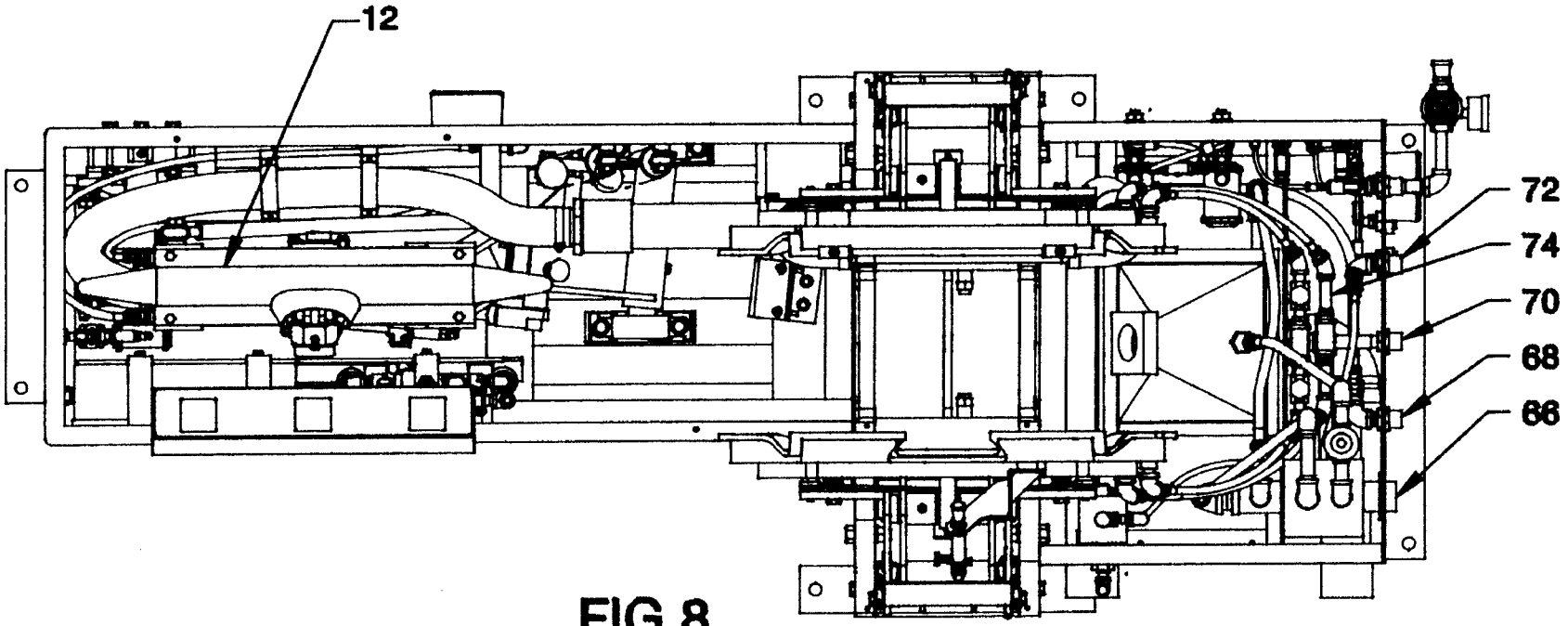
FIG. 8 is a top plan view of the components shown in FIG. 7.

The buck is mounted from beneath by parallel arms 20 for lateral movement between a loading zone 22 and a finishing zone 24. Note in particular FIGS. 5 and 7. The buck has a clamp 26 in the neck area for the collar of the shirt to be pressed. The buck also has two short shoulder rods 28. Such shoulder rods are for holding the shoulders of the shirt in proper orientation during the finishing operation.

Also provided on the buck 12 are a pair of arm clips 30. These clips are for receiving the cuffs of the sleeves of the shirt to be pressed. The clips receive the area of the shirt sleeve where the end of the sleeve and cuff join. The clips function so that during the finishing operation, a sealing function occurs.

More particularly, the clips include elongated generally vertical arms 32 positioned on the opposite lateral sides of the buck. They are moveable with the buck between the loading and finishing zones. The lower ends of the arms are supported by pins for independent rotation toward the lateral sides of the buck and away therefrom. The clips are formed with resiliently urged fingers 34 at their upper ends. These fingers are adapted to receive the appropriate area of the shirt on the buck to be finished. They form an obstruction for the flow of heated air and steam therethrough during the finishing operation to effect an appropriate finishing of the shirt.

A blower 38 is provided for the apparatus. The blower is seen in the lower right of FIG. 1 and the lower left of FIG. 2. The blower is for directing a flow of ambient air with respect to the apparatus in one path or the other. More specifically, it draws air through the buck in a vacuum mode when the buck is in the loading orientation. It feeds air to the buck to a assist in finishing a shirt when the buck is in the finishing zone.

There are shown in FIG. 1, two crossing lines 40 and 42. The line on the top is the vacuum or negative pressure line. The line therebeneath is the positive pressure line. The impeller within the blower, not shown, always rotates in the same direction to provide different directions of air flow. There are two chimneys 46 and 48. When the buck is in the loading zone, a vacuum is desired to hold the shirt onto the buck. In this orientation, as will be described later, the valves are oriented to close off chimney 46 but to allow a vacuum to be drawn through the buck and exhausting to atmosphere through chimney 48. When the buck is in the finishing operation, the valves are oriented to close off chimney 48 and open valve 41 to effect a flow of positive air pressure from the atmosphere through its associated chimney and into the buck.

Associated mechanisms for the finishing operation are provided with the apparatus. These include a spray gun 52 for moistening the shirt in areas if and when needed. Also included is a mirror 54 on the reverse side of the apparatus to increase the operator's visibility of the activities.

Operable in association with the buck during the pressing operation at the finishing zone are a pair of similarly shaped chests 56. Note FIGS. 1, 2 and 7. The chests are of a similar construction and are adapted to be heated through a flow of steam therethrough. They have interior surfaces 58 contoured to mate with the contour of the adjacent contour of the buck. The chests are mounted on supports 60. The lower ends of the supports are pivoted to move the chests perpendicularly with respect to the movement of the chests between an inoperative position remote from the buck and an operative position. In the operative position the chests are closer to each other and close to the buck in pressing contact with a shirt on the buck being finished. Second drive means 62 are provided to move the chests between the inoperative and operative positions.

The steam for the various finishing activities is received from a reservoir 64. The reservoir is replenished from a remote source of steam, not shown, to which it is coupled. In association therewith is a filter vat 65 for high pressure air inlet. Three outlets 68, 70 and 72 are provided adjacent the steam inlet 66. Once the steam enters the apparatus 10, it is diverted through a manifold 74 to three locations. The manifold distributes the steam to the front and rear chests to effect their heating. Steam is directed to a heat exchanger 80 so that air may pass thereover for being heated as it is moved to interior of the buck for finishing. Lastly, steam is provided to a reservoir 64 as described above for being conveyed into the sleeves through steam nozzle 92 connected to a line 82 in the air flow line 84 during the finishing operation.

Figures 3, 4:
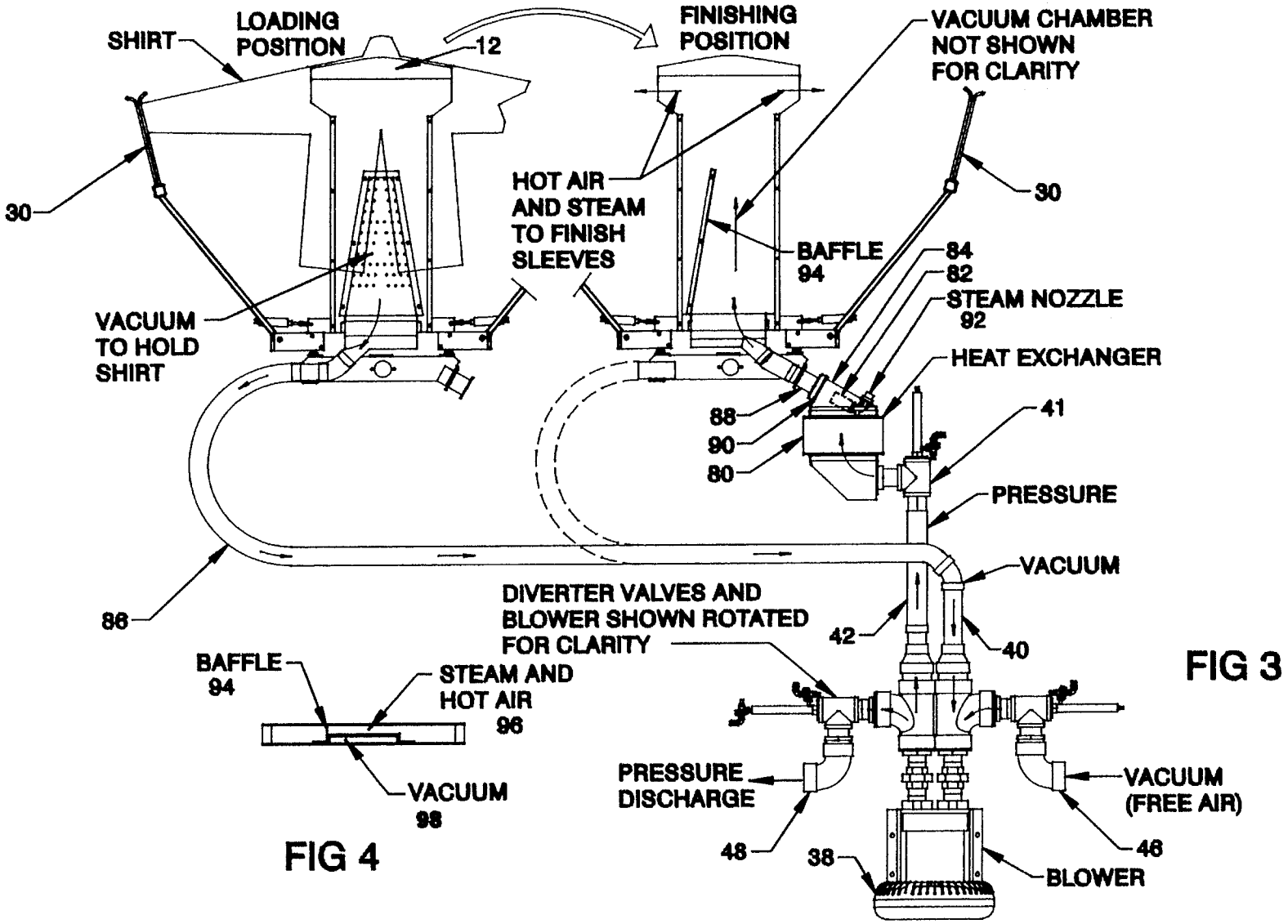
FIG. 3 is a schematic illustration of the buck from the prior Figures illustrating its motion between the loading and finishing zones.
FIG. 4 is a cross sectional view taken along line A—A of FIG. 3.

FIGS. 3 and 4 illustrate the flow of positive and negative air pressure into the air flow lines of the buck for vacuum and finishing. A flexible tube 86 conveys air from the buck through the blower for the vacuum hold-down function at the loading zone. Further, a short line 88 is inoperative when the buck is at the loading zone. When, however, the buck moves to the finishing zone, the free end couples with an associated line 90 for closing purposes. Such closing allows air to be directed from the blower, over the heat exchanger and into the buck. FIG. 3 also illustrates the steam nozzle 92 for adding steam to the finishing air when the buck is at the finishing zone. FIG. 4 demonstrates a baffle 94 within the buck to provide a first upper zone 96 for the finishing steam and hot air and a smaller zone 98 for the vacuum holding the shirt in position at the loading zone.

More specifically, the vacuum chamber of the buck includes a metallic member 100 interior of the buck. Such member is provided with a plurality of air holes 102. This is the area where ambient air is drawn from interior of the buck to the blower for holding the shirt without additional mechanical hold-down components.

Figure 16:
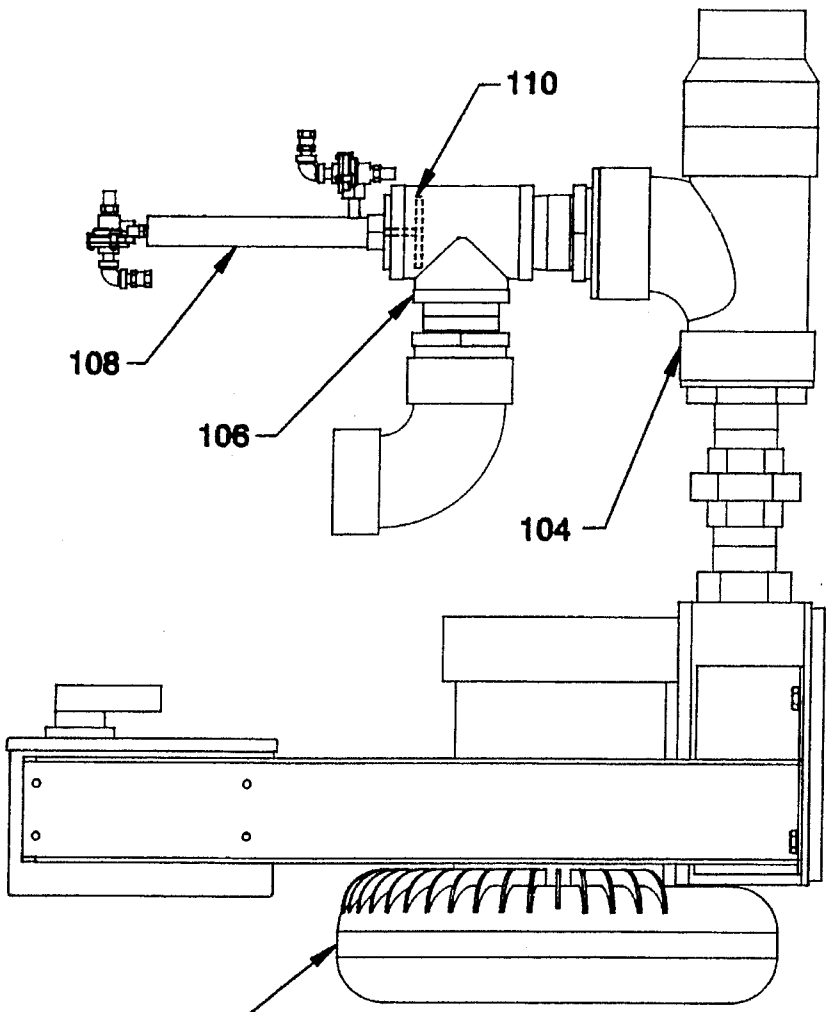
FIG. 16 is a side elevational view of the blower and associated fittings for directing air to and from the operating components of the apparatus.
Figure 17:
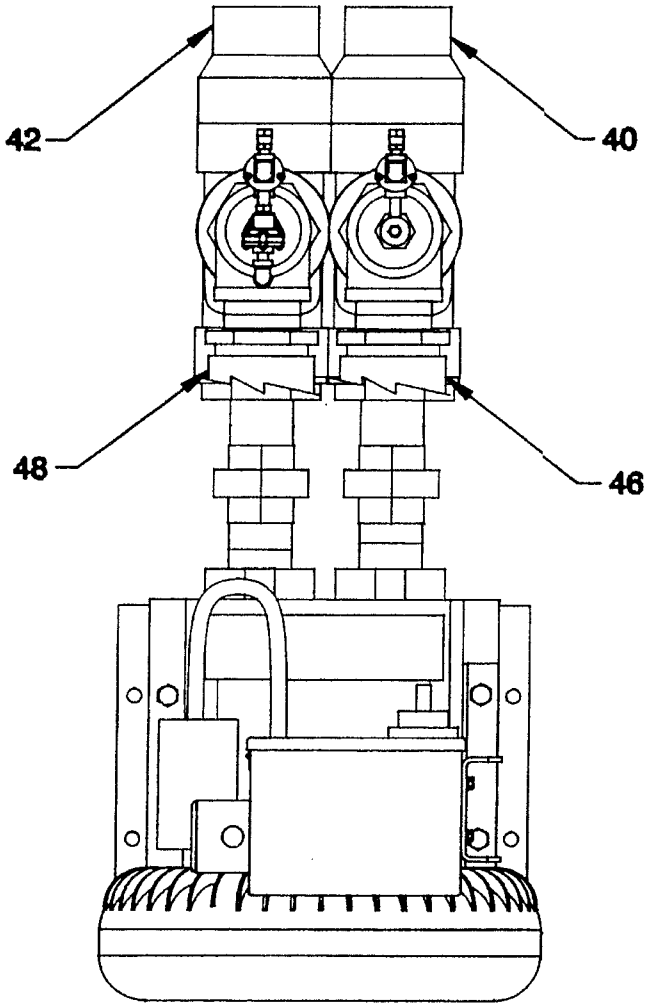
FIG. 17 is a top plan view of the apparatus shown in FIG. 16.

With regard to the blower, such is best seen with reference to FIGS. 16 and 17. In the blower, air comes in from the right side 40 through the blower and out the left side 42. When the apparatus is activated in anticipation of a finishing cycle, air is being continually circulated in one chimney 46 and out the other 48. Air comes in from the lower right and is sucked in by the blower at the lower left. In association therewith, there is a lower large T 104 and above that an upper smaller T 106. These couple the chimneys to the blower and functioning components of the apparatus. In association therewith, there is an air cylinder 108 above each upper T. Plungers 110 are connected to air cylinder 108 and cause the plunger to move up and down within the smaller T in which it is located. This opens or closes the air flow to its associated chimney. A similar cylinder and plunger arrangement is located in valve 41. These three plungers function as valves to control independently the flow of air to the apparatus from its associated chimney. Various types of blowers may be utilized for the desired functions. A preferred blower is a Spencer Vortex Blower. Such blowers are the product of the Spencer Turbine Company of Windsor, Conn. The preferred sizes are 4 horsepower or 7½ horsepower as a function of the size of the voltage cycles.

Figure 9:
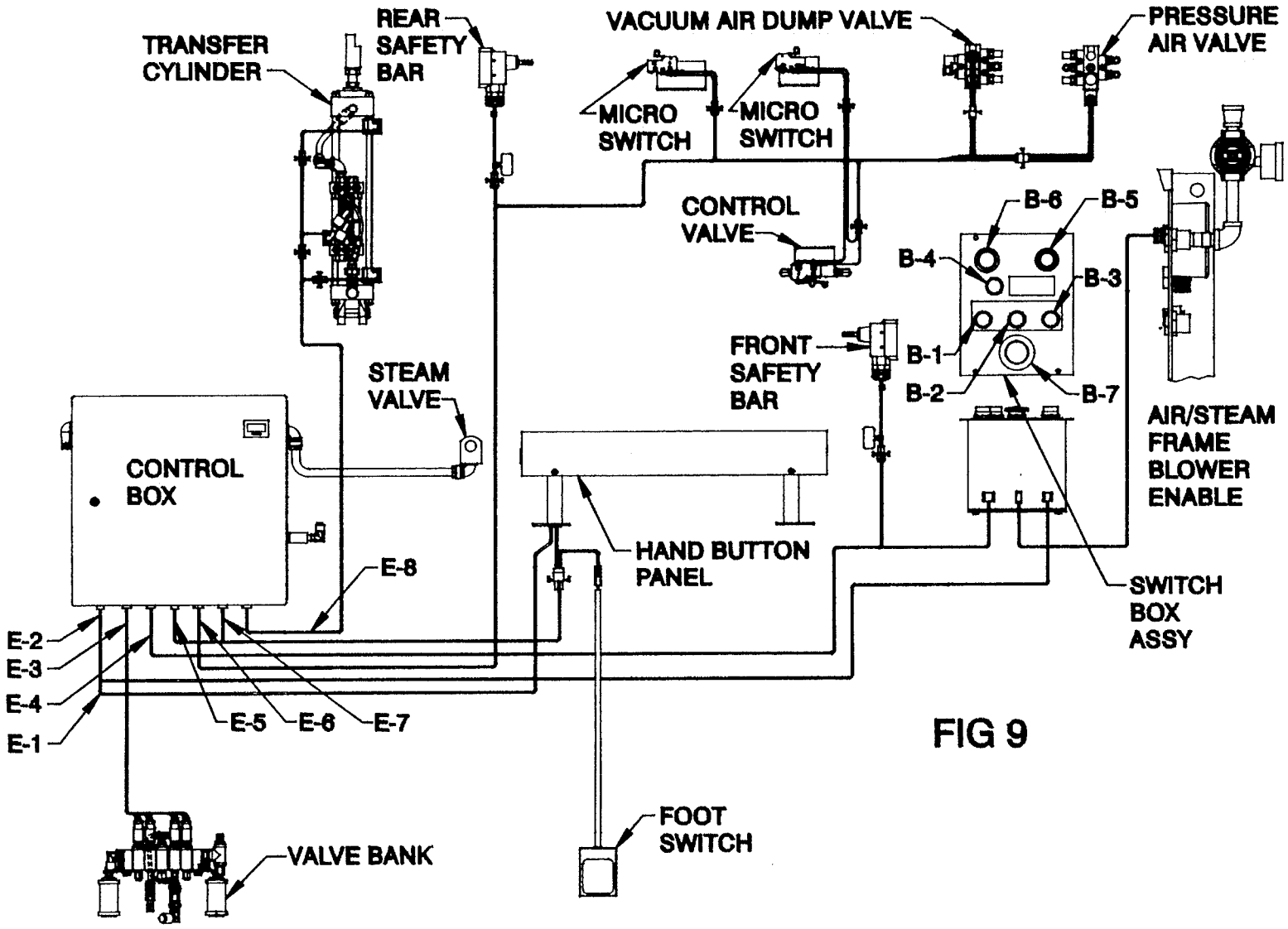
FIG. 9 is an electrical schematic of the controls for operating the apparatus of the prior Figures.

As shown in FIG. 9, the central processing unit for the apparatus is a control box. In association therewith are two operator control regions. The first is a hand button panel and an associated foot switch. When the buck is in the loading position and the foot switch is depressed, the vacuum is turned on to the buck and the arm clips are expanded. When the two laterally spaced hand buttons are depressed by an operator, the buck will move from its loading zone into the finishing zone.

The second operator control region is the switch box assembly. The switch box assembly has buttons to power on/off B-1 and B-2, start the blower B-3, an alternate time sequence for the system B-4 and warning lights and buzzer B-5 and B-6. Also included is an emergency stop button B-7.

Coming out of the control box are a plurality of lines. The first line, E-1, which couples to the hand button panel. This is coupled with respect to the steam valve as a manual shut-off switch to inhibit the steam valve from being automatically energized during the normal cycle of operation.

The second line, E-2, goes to the switch box assembly, which is the primary off/on control for the overall system. The third line, E-3, goes to the valve bank for controlling the pneumatic cylinders for positive pressures to the drive mechanisms and to the diverter valves for all pneumatic cylinders of the system. The fourth line, E-4, goes to the switch box assembly for controlling all the other function in the switch box except for the off/on. The fourth line also operates and controls the front safety bar, not shown. Safety bars are generally vertical bars adjacent to the buck which, if inadvertently contacted by an operator, would reverse the motion of the buck for operator safety. FIG. 1 is to a machine embodiment equipped with extra peripheral guarding. The FIG. 2 embodiment is without some of the peripheral guarding. The fifth line, E-5, goes to the hand button panel for the foot switch to coordinate its operation. Line E-7 couples to the hand buttons of the hand button panel. The sixth line, E-6, goes up to the rear safety bar, which performs a function similar to the front safety bar but on the opposite side of the apparatus. Also controlled from the sixth line are two micro-switches, a head closed switch and a rear head open switch, and the vacuum and pressure air valves as well as the control valve, front head open.

The micro-switch functions to contact the chest arms to verify that the intended timing sequence is being followed during the opening and closing of the chests with respect to the buck.

The vacuum air valve and the pressure air valve are those valves associated with the blower to ensure proper sequencing for controlling plungers of the diverter valve for the blower. The control valve is for verifying the proper orientation of the chests during the operating cycle.

The eighth line, E-8, controls the transfer cylinder. On the transfer cylinder are three reed switches. These switches tell whether the buck is in the loading zone, the finishing zone, or a neutral zone therebetween.

Coming off the switch box assembly to is the air steam frame is the blower enable cable. This operates with the blower on/off of the switch box assembly to a junction box adjacent to the blower for energizing and de-energizing the blower which in effect runs all the time during the operation of the system. The valves and diverters are utilized for changing its mode at various times through the cycle.

Figure 10:
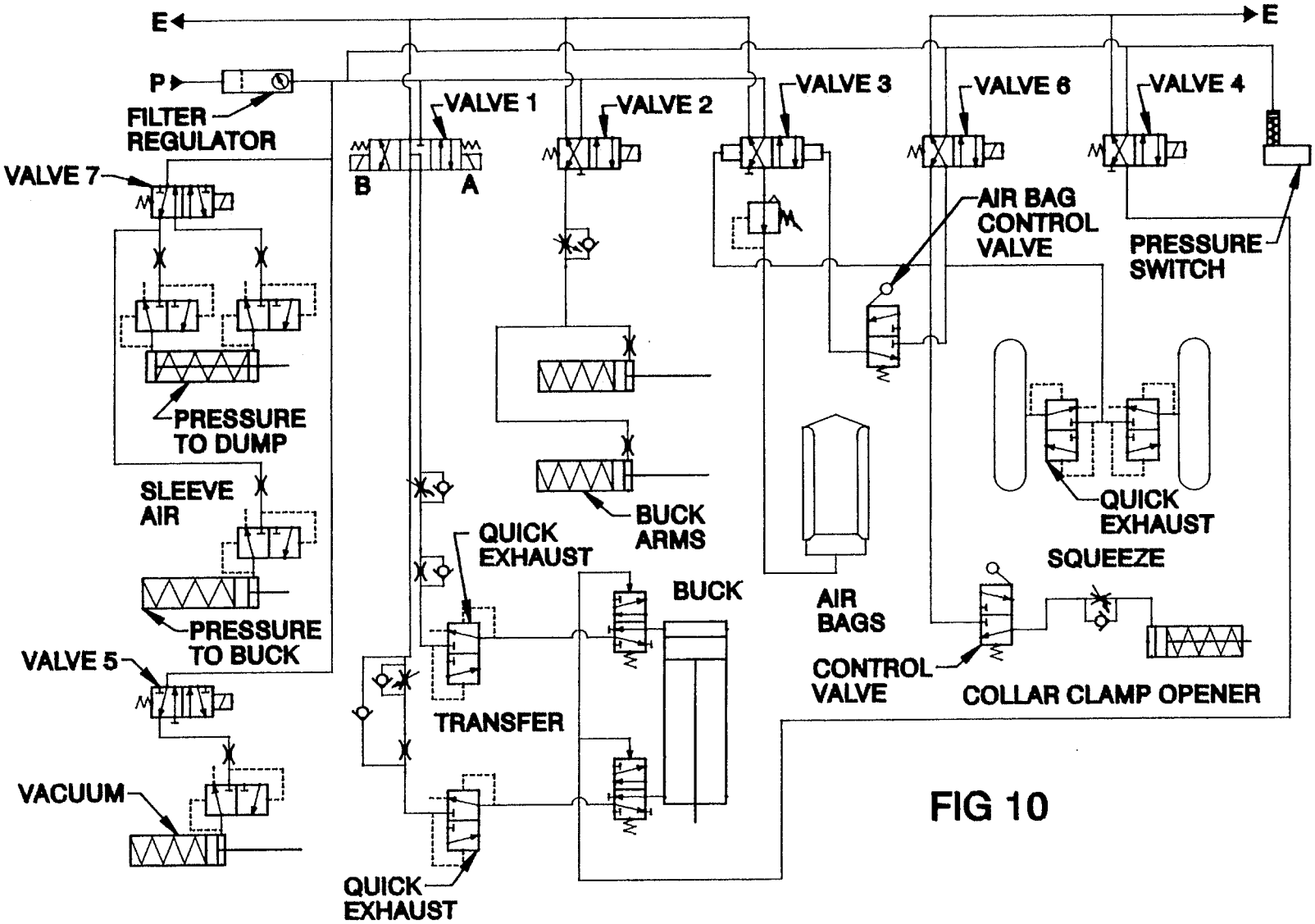
FIGS. 10 and 11 are pneumatic schematic and pneumatic assembly illustrations of the mechanisms for operating the apparatus of the prior Figures.
Figure 11:
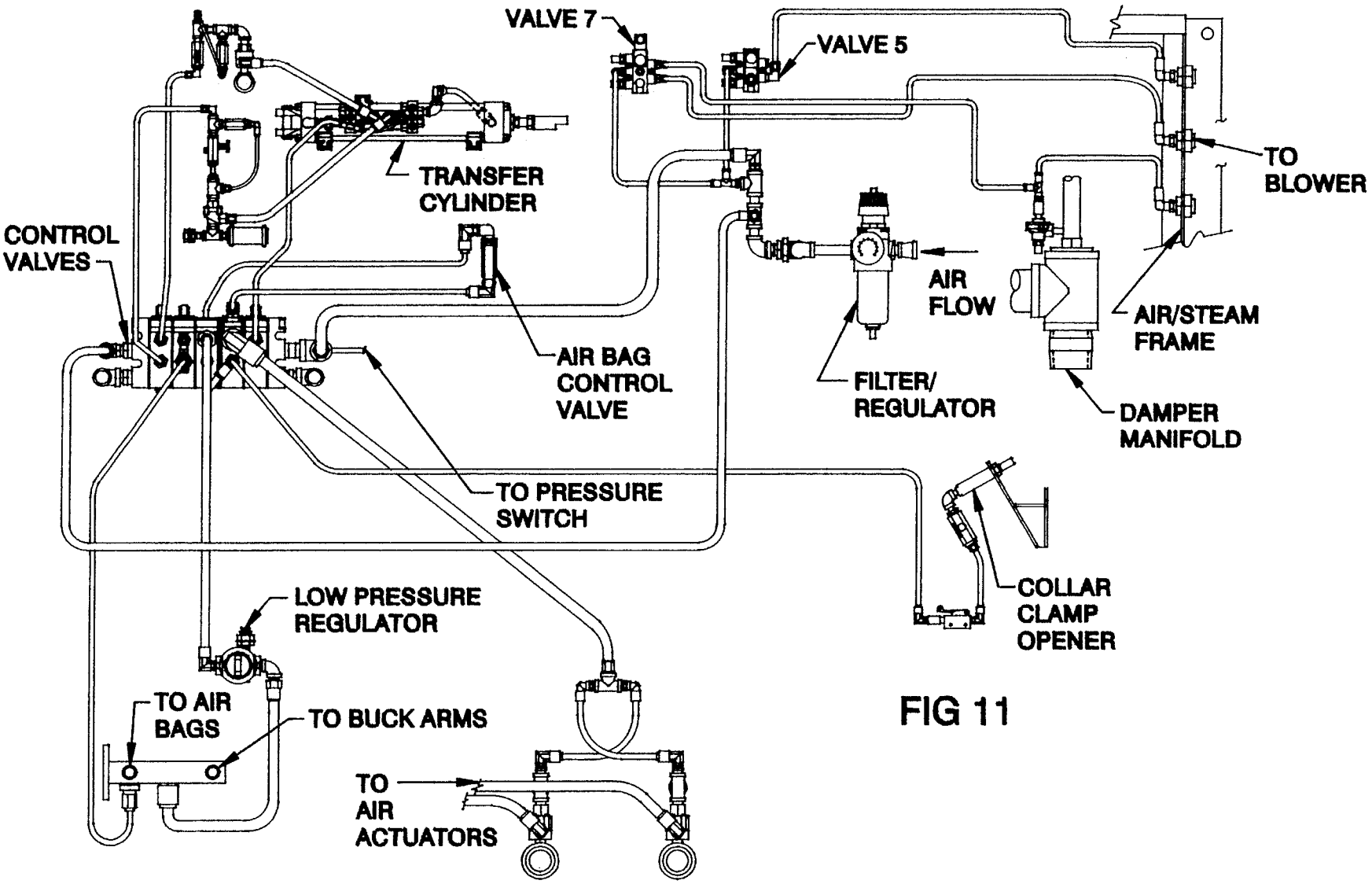
Figure 12:
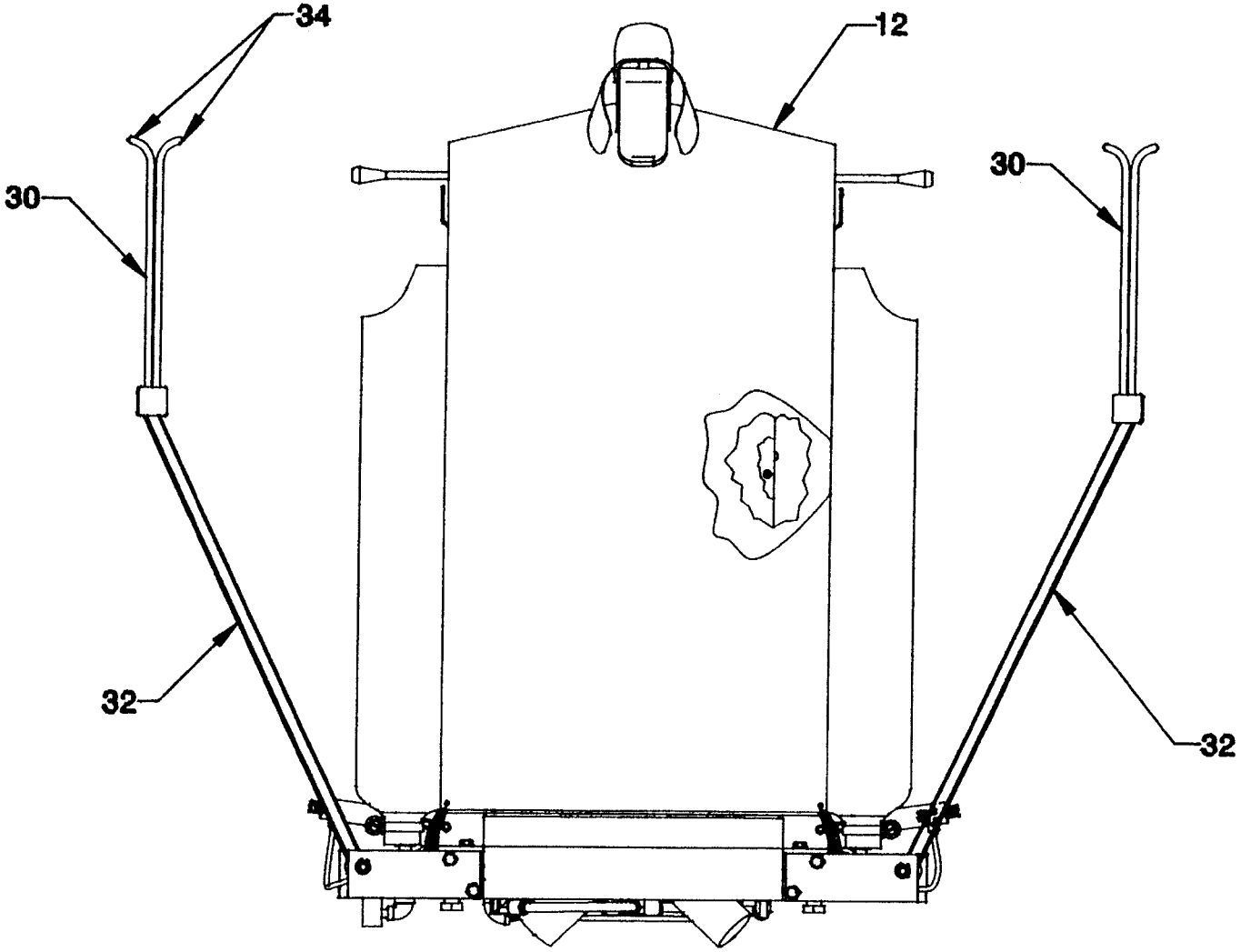
FIG. 12 is a front elevational view of the buck, clips and associated supports.

Shown in FIGS. 10 and 11 are the pneumatic schematic and pneumatic assembly. Shown in FIG. 10 are the P for pressure for a source of pressurized air and the E for exhaust. The filter regulator controls the quantity and the cleanliness of the air and it maintains proper pressure.

This is the high pressure air for actuating the various pneumatic valves throughout the system. This is not to be confused with the low pressure air generated by the blower for drawing vacuum in the buck and for finishing the sleeves.

Referring again to FIG. 10, valve 1 is for the control of the buck transfer cylinder 120. This is for movement between the loading and finishing zones. Valve 2 controls the buck arms for moving the clips into closeness or remoteness of the buck through cylinder 122. Valve 3 controls inflation of the air bags on the side of the buck for finishing the sides of the shirt.

Valve 4 goes to the safety valves which are mounted to the transfer cylinder. These are energized when a transfer of the buck is initiated. They are de-energized at the end of the squeeze cycle effected by the chests. Valve 5 is for a vacuum diverter valve. Valve 6 also closes the chests to the squeeze against the buck. Also off of valve 6 is a sequencer which will detect the appropriate closing of the chest with respect to the buck and allow the filling of the side air bags on the buck. Also off of valve 6 is a collar clamp opener 126. The collar clamp is manually placed into position when the buck is in the loading position with the collar of the shirt appropriately located on the buck. After the finishing and pressing cycle have been completed and the chests move away from the buck, the collar clamp is opened. Valve 7 controls the pressure diverter.

The sequence of operation involves three major functions, operator input to transfer the buck in from the loading zone to the finishing zone, the squeeze cycle whereat the shirt body is pressed and its sleeves are finished, and the transfer out wherein the buck is moved from the finishing zone to the loading zone.

The first part of the cycle involves an operator pressing the foot switch momentarily. Thereafter valve 2 is energized to extend the sleeves and valve 5 is energized to turn on the vacuum to the buck. Thereafter, if the foot switch is depressed a second time, valves 2 and 5 are de-energized. The foot switch may be depressed as many times as required before a transfer is to be initiated. Valves 2 and 5 must be energized before a transfer is allowed. With valves 2 and 5 energized, transfer hand buttons one and two are depressed to transfer the buck. At this time, valves 1A and four, transfer enable, are energized to move the buck into the finishing zone, the squeeze position. During the transfer cycle, the warning lamp is illuminated. The buck out switch is de-activated, the buck center switch is momentarily activated and the buck in switch is activated. The center of the three hand buttons is for cancel of buck movement or the squeeze cycle in the event of an emergency.

For the squeeze cycle at the finishing zone, the buck in switch is activated. Valve 6 is energized to close the pressing heads, and the transfer warning lamp is turned off. Thereafter, the head closed switch is activated. In response thereto, the steam valve is energized for about four seconds through the fixed timer, valve 7 is energized to allow hot air to the buck, valve 5 is de-energized to open the dump valve and turn off the vacuum and the squeeze timer is activated through its normal controlled sequence. Thereafter, the squeeze timer is timed out whether done normally or abnormally, valve number 6 is de-energized to open the heads, the counter is activated. Next the head closed switch is de-activated whereby valve 1A is de-energized and valve 4 is de-energized. Lastly, the head open switch is activated whereupon valve 7 is de-energized to stop the sleeve air and the steam valve is de-energized if not already timed out.

The last part of the sequence is the transfer out. This begins with the head open switch being activated whereby valve 1B and valve 4 are energized to return the buck to the out or loading position while the transfer warning lamp and transfer warning buzzer are activated. Thereafter, the buck center switch is activated momentarily and valve 2 is de-energized to re-tract the sleeve extenders. Lastly, the buck out switch is activated whereby valve 1B and valve 4 are de-energized and the transfer warning lamp and transfer warning buzzer are turned off.

The present invention includes the apparatus as described above as well as the method for concurrently pressing the front and back of a shirt and finishing the sleeves through the use of a single source of air pressure. The method includes the steps of providing the apparatus as described above as well as using such apparatus in the manner as described above. The method also includes the step of applying positive air pressure to the buck when in the finishing zone and applying negative air pressure when the buck is in the loading zone, the applying being effected from a single blower and associated valves and controls.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. Apparatus for concurrently pressing the front and back of a shirt and finishing the sleeves through the use of a single source of air pressure comprising, in combination:

a buck in the general form of a wearer having a front and a back and opposite lateral sides therebetween and adapted to hold at least the front and back of the shirt in an orientation for being pressed;

first drive means to move the buck between a loading zone and a finishing zone;

pair of chests positioned adjacent to the buck at the finishing zone, the chests being movable between an inoperative position remote from the buck and an operative position proximate to each other and the buck and in pressing contact with a shirt on the buck;

second drive means to move the chests between the inoperative and operative positions;

a pair of clips, the clips including elongated generally vertical arms positioned on the opposite lateral sides of the buck and movable therewith between the loading and finishing zones, the lower ends of the arms being supported for independent rotation toward the lateral sides of the buck and away therefrom, the clips being formed with resiliently urged fingers at their upper ends and adapted to receive an area of a shirt on the buck to be finished at the region between the cuff and sleeve to form an obstruction for the flow of heated air and steam therethrough during a finishing operation;

third drive means to retain the clips toward each other and the opposite lateral sides of the buck when the buck is in the loading zone and to retain the clips away from each other and the buck when the buck is in the finishing zone;

steam lines for coupling (1) a reservoir of steam with the steam nozzle for live steam to be utilized during the finishing operation, (2) a heat exchanger over which air moving to the buck will pass and (3) in closed loops to the chests;

air lines for coupling a source of negative air pressure and the buck to draw a vacuum through the buck when the buck is in the loading zone for holding a shirt against the buck and to provide a positive air pressure to interior of the buck when the buck is in the finishing zone to force the sleeves outwardly to effect their finishing; and a single blower coupled to a positive pressure chimney and a negative pressure chimney and to the buck with associated control mechanisms to alternately apply to the buck positive air pressure when the buck is in the finishing zone and negative air pressure when the buck is in the loading zone.

2. Apparatus for finishing a shirt comprising:

a buck with a first drive means to move the buck between a loading and a finishing zone;

a pair of chests positioned adjacent to the buck at the finishing zone with a second drive means to move the chests between inoperative and operative positions;

a pair of clips attached adjacent to the buck to receive an area of a shirt on the buck to be pressed at the region between the cuff and sleeve and to form an obstruction for the flow of heated air and steam therethrough during a finishing operation;

steam lines for coupling a source of steam to the interior of the chests;

air lines for coupling a source of negative air pressure to the buck for drawing a vacuum through the buck when the buck is in the loading zone for holding a shirt against the buck and to provide a positive air pressure to the interior of the buck to force the sleeves outwardly to effect their finishing; and a single blower to generate a positive air pressure and a negative air pressure coupled to the buck with associated control mechanism to apply positive air pressure to the buck when in the finishing zone and then negative air pressure to the buck when in the loading zone.

3. A method for concurrently pressing the front and back of a shirt and finishing the sleeves through the use of a single source of air pressure comprising:

providing a buck in the general form of a wearer having a front and a back and opposite lateral sides therebetween and adapted to hold at least the front and back of the shirt in an orientation for being pressed;

providing first drive means to move the buck between a loading zone and a finishing zone;

providing a pair of chests positioned adjacent to the buck fat the finishing zone, the chests being movable between an inoperative position remote from the buck and an operative position proximate to each other and the buck and in pressing contact with a shirt on the buck;

providing second drive means to move the chests between the inoperative and operative positions;

providing a pair of clips, the clips including elongated generally vertical arms positioned on the opposite lateral sides of the buck and movable therewith between the loading and finishing zones, the lower ends of the arms being supported for independent rotation toward the lateral sides of the buck and away therefrom, the clips being formed with resiliently urged fingers at their upper ends and adapted to receive an area of a shirt on the buck to be finished at the region between the cuff and sleeve to form an obstruction for the flow of heated air and steam therethrough during a finishing operation;

providing third drive means to retain the clips toward each other and the opposite lateral sides of the buck when the buck is in the loading zone and to retain the clips away from each other and the buck when the buck is in the finishing zone;

providing steam lines for coupling (1) a reservoir of steam with the steam nozzle for live steam to be utilized during the finishing operation, (2) a heat exchanger over which air moving to the buck will pass and (3) in closed loops to the chests;

providing air lines for coupling a source of negative air pressure and the buck to draw a vacuum through the buck when the buck is in the loading zone for holding a shirt against the buck and to provide a positive air pressure to interior of the buck when the buck is in the finishing zone to force the sleeves outwardly to effect their finishing;

providing a single blower coupled to a positive pressure chimney and a negative pressure chimney and to the buck with associated control mechanisms to alternately apply positive air pressure to the buck when in the finishing zone and negative air pressure when the buck is in the loading zone; and applying to the buck positive air pressure when the buck is in the finishing zone and applying negative air pressure when the buck is in the loading zone, the applying being effected from a single blower and associated valves and controls.

4. A method for finishing a shirt comprising:

providing a buck with a first drive means to move the buck between a loading and a finishing zone;

providing a pair of chests positioned adjacent to the buck at the finishing zone with a second drive means to move the chests between inoperative and operative positions;

providing a pair of clips attached adjacent to the buck to receive an area of a shirt on the buck to be pressed at the region between the cuff and sleeve and to form an obstruction for the flow of heated air and steam therethrough during a finishing operation;

providing steam lines for coupling a source of steam to the steam nozzle;

providing air lines for coupling a source of negative air pressure to the buck for drawing a vacuum through the buck when the buck is in the loading zone for holding a shirt against the buck and to provide a positive air pressure to interior the buck to force the sleeves outwardly to effect their finishing;

providing a single blower to generate a positive air pressure and a negative air pressure coupled to the buck with associated control mechanism to apply positive air pressure to the buck when in the finishing zone and negative air pressure to the buck when in the loading zone; and applying positive air pressure to the buck when in the finishing zone and then applying negative air pressure when the buck is in the loading zone, the applying being effected from a single blower and associated valves and controls.

* * * * *